United States Patent [19]

Szwartz

[11] 4,081,018

[45] Mar. 28, 1978

[54] STORM DOOR AND SCREEN COMBINATION FOR A GARAGE

[75] Inventor: Henry S. Szwartz, Suffern, N.Y.

[73] Assignee: The Raymond Lee Organization, Inc., New York, N.Y. ; a part interest

[21] Appl. No.: 809,378

[22] Filed: Jun. 23, 1977

[51] Int. Cl.[2] ..... E06B 3/48

[52] U.S. Cl. ..... 160/113; 49/63

[58] Field of Search ..... 160/87, 89, 113, 114, 160/115, 116; 52/79.6; 49/61, 63

[56] References Cited

U.S. PATENT DOCUMENTS

| | | | |
|---|---|---|---|
| 225,680 | 3/1880 | Barkheimer | 160/89 |
| 1,080,417 | 12/1913 | Clark | 52/79.6 |
| 3,004,592 | 10/1961 | Norton | 160/114 |
| 3,021,896 | 2/1962 | Buone et al. | 160/113 |
| 3,103,967 | 9/1963 | Gaschen | 160/113 |
| 3,926,242 | 12/1975 | Lowe | 160/89 |

*Primary Examiner*—Peter M. Caun

*Attorney, Agent, or Firm*—Daniel Jay Tick

[57] ABSTRACT

An awning extends from a wall of a garage over the top of the doorway to the garage. A plurality of storm door sections are hingedly affixed to each other vertically and slidably mounted in guide tracks beneath the awning for positioning in a plane parallel to the wall of the garage. A plurality of screen sections are hingedly affixed to each other horizontally and slidably mounted in additional guide tracks beneath the awning for positioning in a plane parallel to the wall of the garage.

1 Claim, 3 Drawing Figures

STORM DOOR AND SCREEN COMBINATION FOR A GARAGE

BACKGROUND OF THE INVENTION

The present invention relates to a storm door and screen combination for a garage. More particularly, the invention relates to a storm door and screen combination for a garage having a wall with a doorway formed therethrough.

Objects of the invention are to provide a storm door and screen combination for a garage, which storm door and screen combination is of simple structure, inexpensive in manufacture, installed with facility and convenience on new and existing garages, and functions efficiently, effectively and reliably to provide storm protection and warm weather insect protection for occupants of the garage.

BRIEF DESCRIPTION OF THE DRAWINGS

In order that the invention may be readily carried into effect, it will now be described with reference to the accompanying drawings, wherein.

DETAILED DESCRIPTION OF THE INVENTION

The storm door and screen combination of the invention is for a garage 1 having a wall 2 with a doorway 3 (FIG. 3) formed therethrough.

The storm door and screen combination of the invention comprises an awning 4 extending substantially perpendicularly from the wall 2 over the top of the doorway 3.

Figure 1:
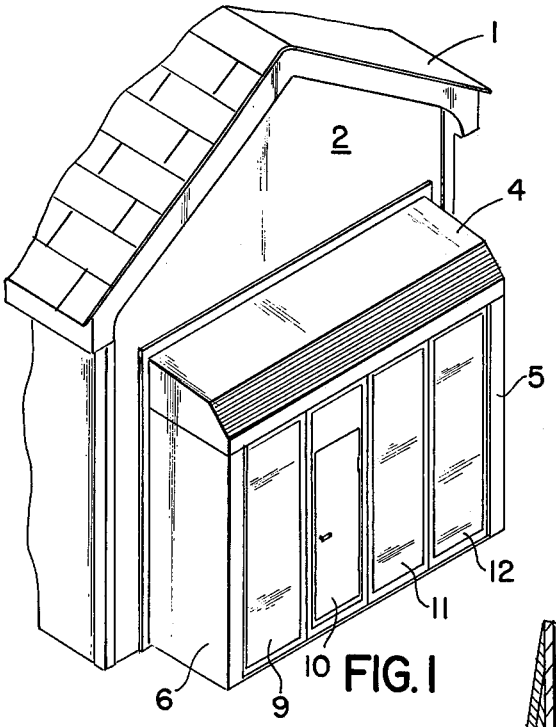
FIG. 1 is a perspective view of an embodiment of the storm door and screen combination for a garage, with the storm sections of the combination in position enclosing the doorway of the garage.
Figure 2:
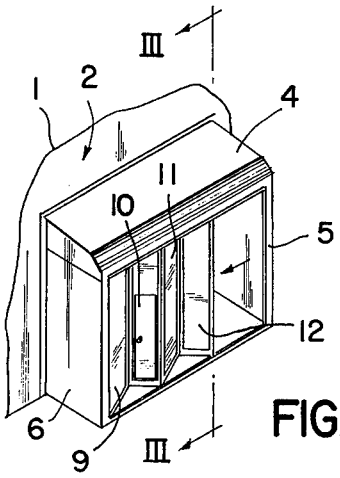
FIG. 2 is a perspective view, on a reduced scale, of the embodiment of FIG. 1, with the storm sections of the combination partly opened.

A pair of sides 5 and 6 extend substantially perpendicularly from the wall 2 at the sides of the doorway 3 from the awning 4 to the bottom of the doorway, as shown in FIGS. 1 and 2.

An upper guide track 7 (FIG. 3) extends substantially horizontally along the edge of the awning 4 farthest from the garage 1. A lower guide track 8 (FIG. 3) extends substantially horizontally between the sides 5 and 6 at the bottoms thereof in a plane with the upper guide track 7 substantially parallel to the wall 2 of the garage 1.

Figure 3:
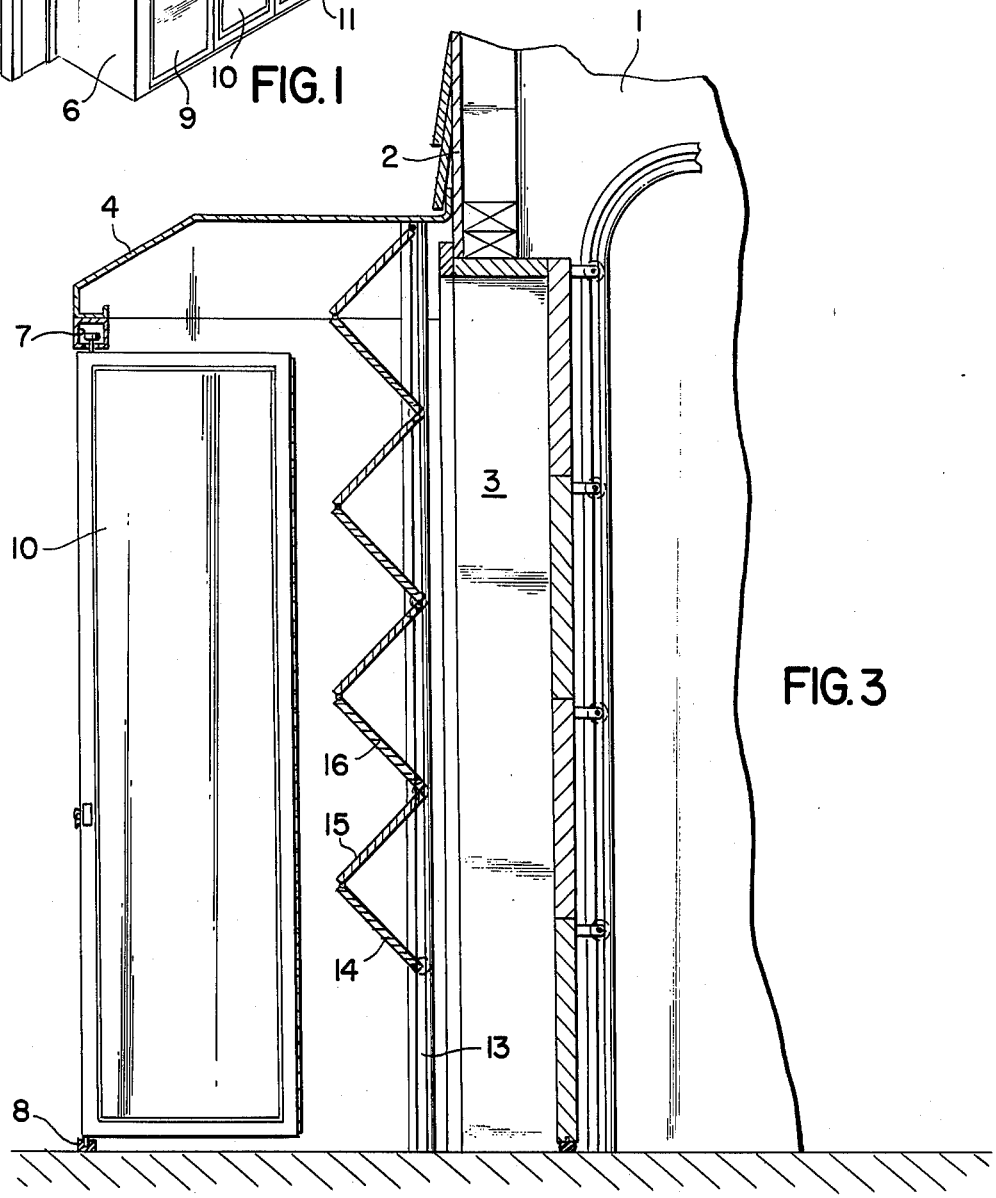
FIG. 3 is a view, on an enlarged scale, partly in section, taken along the lines III—III, of FIG. 2.

A plurality of storm door sections 9, 10, 11 and 12 (FIGS. 1 and 2) are hingedly affixed to each other along substantially vertical lines and are slidably mounted in the upper and lower guide tracks 7 and 8 for positioning in a plane parallel to the wall of the garage, as shown in FIG. 1, thereby completely enclosing the doorway, and in accordion fashion, as shown in FIGS. 2 and 3, to provide a desired opening.

A door is provided in the storm door section 10 to permit passage when the storm door sections are in their closed condition completely enclosing the doorway 3 of the garage.

A pair of side guide tracks, of which one track 13 is shown in FIG. 3, extend substantially vertically along the sides 5 and 6, each facing the other, in a plane substantially parallel to the wall 2 of the garage.

A plurality of screen sections 14, 15, 16, and so on (FIG. 3), are hingedly affixed to each other along substantially horizontal lines and are slidably mounted in the side guide tracks 13, and the equivalent track, not shown in the FIGS., for positioning in a plane parallel to the wall 2 of the garage, thereby completely screening the doorway, and are movable in accordion fashion to provide a desired opening from the ground, as shown in FIG. 3.

Thus, when the storm door sections 9 to 12 are in use, the screen sections 14 to 16, and so on, are folded in accordion style at the top of the awning 4. When the screen sections 14 to 16, and so on, are in use, the storm door sections 9 to 12 are folded in accordion style against the wall 6.

While the invention has been described by means of a specific example and in a specific embodiment, I do not wish to be limited thereto, for obvious modifications will occur to those skilled in the art without departing from the spirit and scope of the invention.

I claim:

1. A storm door and screen combination for a garage having a wall with a doorway formed therethrough, said storm door and screen combination comprising an awning extending substantially perpendicularly from the wall over the top of the doorway;

a pair of sides extending substantially perpendicularly from the wall at the sides of the doorway from the awning to the bottom of the doorway;

an upper guide track extending substantially horizontally along the edge of the awning farthest from the garage;

a lower guide track extending substantially horizontally between the sides at the bottoms thereof in a plane with the upper guide track substantially parallel to the wall of the garage;

a plurality of storm door sections hingedly affixed to each other along substantially vertical lines and slidably mounted in the upper and lower guide tracks for positioning in a plane parallel to the wall of the garage thereby completely enclosing the doorway and in accordion fashion to provide a desired opening;

a pair of side guide tracks extending substantially vertically along the sides each facing the other in a plane substantially parallel to the wall of the garage; and a plurality of screen sections hingedly affixed to each other along substantially horizontal lines and slidably mounted in the side guide tracks for positioning in a plane parallel to the wall of the garage thereby completely screening the doorway and in accordion fashion to provide a desired opening from the ground.

* * * * *